US005866669A

United States Patent [19]

Takatsu et al.

[11] Patent Number: 5,866,669

[45] Date of Patent: Feb. 2, 1999

[54] SULFONATED PHENOL-FORMALDEHYDE RESIN FOR PAPER-MAKING

[75] Inventors: Hisao Takatsu, Kyoto, Japan; Seika Tay, Vancouver, Wash.; Mitsuyoshi Kato, Nishi Kasugai-gun; Masafumi Yoshikawa, Kyoto, both of Japan

[73] Assignee: Meisel Chemical Works, Ltd., Kyoto, Japan

[21] Appl. No.: 865,094

[22] Filed: May 29, 1997

[30] Foreign Application Priority Data

Jan. 9, 1996 [JP] Japan ..... 8-20375

[51] Int. Cl.[6] ..... C08G 8/04

[52] U.S. Cl. ..... 528/129; 162/164 R

[58] Field of Search ..... 162/164 R; 528/129

[56] References Cited

U.S. PATENT DOCUMENTS 4,070,236 1/1978 Carrard et al. ..... 162/164 R

*Primary Examiner*—Terressa Mosley

*Attorney, Agent, or Firm*—Morgan & Finnegan, L.L.P.

[57] ABSTRACT

A method for the improvement of yield and freeness which does not discolor the paper product and gives a long life to the product and exerts stable yield improving effect even for the paper stuff containing much deinked pulp and filler as well as a yield improving promotor used in this method are provided.

In the method for the improvement of yield and freeness in the paper-making process and the waste water treating process according to the present invention, a special phenol resin is used in combination with polyethylene oxide (PEO). The phenol resin of the present invention is a sulfonated phenol-formaldehyde resin synthesized by sulfonating a phenol and then condensing it with formaldehyde. Preferred as the phenol to be sulfonated are Bisphenol A and Bisphenol S.

By using the method of the present invention, the yields of fine fiber and filler can be improved and the paper stuffs can be saved and the waste water treating load can be decreased.

2 Claims, No Drawings

SULFONATED PHENOL-FORMALDEHYDE RESIN FOR PAPER-MAKING

FIELD OF THE INVENTION

The present invention relates to a method for the improvement of yield of fine fibers and the filler and also the improvement of freeness in the paper-making process and a sulfonated phenol-formaldehyde resin (referred to as SPFR hereinafter) used as the promotor in combination with polyethylene oxide (referred to as PEO hereinafter) in the above method.

BACKGROUND OF THE INVENTION

In the paper-making process for newspaper and telephone directory paper and so, various yield-improving systems have been adopted for the purpose of improvement in the yield of fine fibers and fillers and improvement of freeness. Among them, the technology using polyethylene oxide as a yield-improving agent has an advantage in that it is not affected by a large amount of water-soluble anionic substance and suspended colloid substance contained in the paper stuff. In the yield-improving system by PEO, it is not substantially used alone but various agents are used in combination (yield-improvement promotor). Various water-soluble phenol resins have been developed as effective promotors.

However, when a well-known water-soluble phenol resin is added, the pH of paper stuff becomes high. When the amount of the phenol resin is increased, the paper product is discolored, the life of the product is reduced and it is hardened by thickening and self-crosslinking.

Further, in the case of a combination of a phenol resin and PEO according to the conventional technology, it has been pointed out that the yield becomes unstable by admixture of a deinking agent originated from deinked pulp (referred to as DIP hereinafter) thereby effecting the yield of fillers and making the removal of sticky materials are insufficient.

The subject of the present invention is to solve the conventional problems described above and to provide a method for the improvement of yield and freeness in the paper-making and waste water treating process which gives no discoloration of paper product and extends the product life and can exert stable yield improving effect on the paper product containing a large amount of DIP and filler.

Further, the subject of the present invention is to provide an excellent yield improvement promotor for paper-making which is a phenol resin used in combination with PEO in the method and gives no discolorarion of paper product and extends the product life and can exert stable yield improving effect on the paper product containing a large amount of DIP and filler.

We, inventors, have investigated eagerly to solve the above problems and have found that a reaction product able to provide an aqueous solution of neutral to acidic, to give no discoloration of paper product and to extend the product life and to exert stable yield improving effect on the paper product containing a large amount of DIP and filler can be obtained by sulfonating a phenol and then condensing it with formaldehyde, and have found that the improvement of yield and freeness in the paper-making and waste water treating process can be attained when the reaction product is used in combination with PEO to complete the present invention.

SUMMARY OF THE INVENTION

The method for the improvement of yield and freeness in the paper-making process and the waste water treating process according to the present invention wherein a combination of a yield and freeness improver and a polyethylene oxide is added to a paper stuff and said yield and freeness improver is a sulfonated phenol-formaldehyde resin for paper-making, said resin being synthesized by sulfonating a phenol and then condensing it with formaldehyde. The preferred phenols to be sulfonated are bis(4-hydroxyphenyl) sulfone marketed as Bisphenol S and 4,4'-dihydroxydiphenyl-2,2-propane marketed as Bisphenol A. Those provided by various manufacturers can be also used.

The sulfonated phenol-formaldehyde resin (SPFR) for paper-making used in the method is a phenol resin used in combination with a polyethylene oxide as the yield and freeness improver in the paper-making and waste water treating process said phenol resin is synthesized by sulfonating a phenol and then condensing with formaldehyde. Preferred phenols to be sulfonated are bis (4-hydroxyphenyl) sulfone, 4,4'-dihydroxydiphenyl-2,2-propane, 1-naphthol and 2-naphthol. The phenol to be sulfonated can have at least one substituent, which may be positioned at any of 2-, 3-, 4-, 5- and 6-positions of the benzene ring.

The SPFR for paper-making in the present invention may be a product synthesized by sulfonating a mixture containing a combination of at least two selected from the group consisting of bis(4-hydroxy-phenyl)sulfone, 4,4'-dihydroxydiphenyl-2,2-propane, 1-naphthol and 2-naphthol and then condensing it with formaldehyde. Further, the SPFR for paper-making of the present invention may be the corresponding sodium salt or ammonium salt formed by neutralization.

DETAILED DESCRIPTION OF THE INVENTION

Now, the method for the preparation of the SPFR for paper-making of the present invention will be described.

When the SPFR of the present invention is prepared, the phenol mentioned above is first sulfonated. The method for sulfonating the phenol is not particularly restricted and it can be sulfonated according to a usual method by using sulfuric acid, anhydrous sulfuric acid or chlorosulfonic acid. However, the degree of sulfonation (molar ratio) of the phenol mentioned above is required to be 0.4 or higher to keep water solubility of the final reaction product. Furthermore, a degree of sulfonation of 0.4 to 0.8 is preferable to prevent the decrease and fluctuation of the yield effect when various deinked regenerated old papers (DIP) are admixed. The sulfonation degree of the phenol of less than 0.4 lowers a storage quality of the final reaction product and that of more than 0.8 lowers the yield improving effect.

The method for the condensation reaction of the sulfonated phenol thus prepared and formaldehyde is also not particularly restricted and can be carried out by a usual method. However, when the condensation reaction of the sulfonated phenol and formaldehyde proceeds excessively, the viscosity of the final product becomes undesirably higher. Likewise, when the amount of formaldehyde is too small, the yield effect in paper-making is lowered disadvantageously. Thus, the molar ratio of the sulfonated phenol to formaldehyde is preferably 1:0.3 to 1.5, more preferably 1:0.5 to 0.8.

The average molecular weight of the SPFR is preferably 300 to 3000, more preferably 400 to 1500 from the viewpoint of water solubility, effect and handling.

An aqueous solution of the SPFR thus prepared is neutral or acidic by sulfonation of the phenol and therefore gives no discoloration of the paper product and exerts stable yield improving effect and freeness improving effect.

In the method of the present invention, said SPFR is used in combination with PEO as the yield and freeness improving agent and the weight ratio of SPFR to PEO is preferably 0.1 to 5:1, more preferably 0.5 to 2:1. The concentrations of SPFR and PEO added are preferably 0.005 to 0.05% and 0.001 to 0.03% respectively based on the paper stuff solid. In such concentrations, the yield and the freeness can be improved in the paper-making and waste water treating process.

PREFERRED EMBODIMENTS OF THE INVENTION

Examples wherein the SPFRs of the invention are used as the yield improving agent in paper-making are shown as follows to illustrate the present invention. However, the present invention is not resticted to these Examples.

1. Test Method for Yield Improvement

Equipment: Dynamic Drainage Jar (abbreviated to DDJ) made by Paper Chemisty Laboratory Inc.

Method: 500 ml of paper stuff was fed in the Jar and stirred at a rate of 600 rpm for 10 seconds and then the cock was opened to collect the drain for 30 seconds. The yield was measured from the paper stuff concentration or ash contained in the drain.

2. Paper Stuff

Paper stuff-1: Thermomechanical pulp (TMP), refiner grand pulp (RGP) and medium quality paper broke were mixed at a ratio of 35, 35 and 30% and disintegrated in a standard pulp disintegrator made by Kumagaya Riki Kogyo Co., Ltd. and the paper stuff concentration was adjusted to 1.0% to prepare a test paper stuff sample. Its fine fiber content was 35%.

Paper stuff-2: White water from the paper-making machine for domestic paper using waste paper was used. The white water concentration was 0.12% and the pH was 7.1.

3. Polyethylene Oxide (abbreviated to PEO hereinafter)

PEO: Alcox E-300 (Trade name. manufactured by Meisei Kagaku Kogyo Co., Ltd.) having an average molecular weight of about 8 million was used. An aqueous solution of 0.01% concentration was used for the addition of PEO. The amount added was expressed by g/ton on solid basis for the paper stuff-i and by ppm based on white water for the paper stuff-2.

4. Sulfonated Phenol-Formaldehyde Resin (SPFR)

SPFR-1: Bisphenol-S was used as the phenol. A reaction product having a sulfonating molar ratio of 0.7 and a formaldehyde ratio of 0.7. It had properties of a solid content of 43%, a pH of 3.5 and a viscosity of 100 cp.

SPFR-2: Bisphenol-A was used as the phenol. A reaction product having a sulfonating molar ratio of 0.5 and a formaldehyde ratio of 0.7. It had properties of a solid content of 25%, a pH of 3.0 and a viscosity of 85 cp.

EXAMPLE 1

SPFR-1 was used as the promotor. Paper stuff-1 was used as the paper stuff. The yields (%) when the amount of the promotor added and the amount of PEO added are changed are shown in the following Table 1.

TABLE 1

| Amount of SPFR-1 added | Amount of PEO added and yield (%) | | | | |
|---|---|---|---|---|---|
| (g/ton ) | 0 | 50 | 100 | 150 | 200 |
| 0 | 44.4 | 45.6 | 43.6 | 52.4 | 46.7 |
| 200 | 43.7 | 62.9 | 74.6 | 72.3 | 80.7 |
| 300 | 44.9 | 65.6 | 75.9 | 80.3 | 82.3 |
| 500 | 44.3 | 68.8 | 79.4 | 78.4 | 88.5 |
| 800 | 44.9 | 60.9 | 72.7 | 81.6 | 84.1 |

EXAMPLE 2

SPFR-2 was used as the promotor. Paper stuff-1 was used as the paper stuff. The yields (%) when the amount of the promotor added and the amount of PEO added are changed are shown in the following Table 2.

TABLE 2

| Amount of SPFR-2 added | Amount of PEO added and yield (%) | | | |
|---|---|---|---|---|
| (g/ton ) | 50 | 100 | 150 | 200 |
| 0 | 43.0 | 43.3 | 43.6 | 44.4 |
| 75 | 55.4 | 63.1 | 64.3 | 65.1 |
| 150 | 56.7 | 61.2 | 72.7 | 71.3 |
| 300 | 54.8 | 72.8 | 80.2 | 78.4 |
| 450 | 55.7 | 65.8 | 78.4 | 83.6 |

EXAMPLE 3

Experiment for the comparison of yield of the ash content

TABLE 3

| | Amount of polymer added and yield (%) | | | |
|---|---|---|---|---|
| Promotor | 50 | 100 | 200 | 300 |
| SPFR-1 *1 | 37.5 | 48.3 | 60.5 | 72.5 |
| Phenol resin *2 | 25.7 | 31.0 | 43.5 | 58.5 |
| PAAM-1 system *3 | 21.5 | 29.5 | 33.8 | 45.5 |
| PAAM-2 system *4 | 30.0 | 39.8 | 42.2 | 45.2 |

Remarks

| Paper stuff composition: | | |
|---|---|---|
| | TMP | 50% |
| | Mechanical pulp | 15% |
| | Bleached pulp | 10% |
| | Deinked pulp | 5% |
| | Filler | 20% |

pH of paper stuff: 5.5
The yield when no yield improver was used: 13 to 15%
Phenol resin: Commercial product. pH: 11.5

*1, *2: Three times amount was used to the amount of PEO added.
*3: A system of combination of anionic/cationic polyacrylamide.
*4: A cationic modified inorganic filler, 2 kg/ton added.
An anionic polyacrylamide was used as the polymer.

EXAMPLE 4

Experiment for the comparison of yield of fine fiber in white water. Paper stuff-2 was used.

TABLE 4

| Combination of promotor and polymer | Amount of promotor added (ppm) and yield (%) | | | | | |
|---|---|---|---|---|---|---|
| | 5 | 10 | 20 | 40 | 70 | 100 |
| SPFR – 1 / PEO *1 | 67.4 | 90.6 | 95.0 | 81.0 | 63.0 | 59.8 |
| C.PAAM *2 / A.PAAM *3 | 53.1 | 42.1 | 40.2 | 47.0 | 48.3 | 89.4 |
| PEI *4 / A.PAAM *3 | 51.7 | 42.4 | 42.6 | 63.3 | 80.6 | 85.5 |

Remarks
*1,*3: Amount of polymer added is 3 ppm based on white water.
*2: Commercial cationic polyacrylamide (coagulant).
*3: Commercial anionic polyacrylamide (coagulant).
*4: Commercial modified polyethylene imine (coagulant).

EXAMPLE 5

Experiment for the comparison of yield when a paper stuff containing 41% of deinked pulp (DIP) is used

TABLE 5

| Promotor name | Amount of promotor added (g/ton) and yield (%) | | | | |
|---|---|---|---|---|---|
| | 0 | 75 | 150 | 250 | 450 |
| SPFR-1 | 46.2 | 57.2 | 60.0 | 65.8 | 69.9 |
| Phenol resin *1 | 45.8 | 53.5 | 53.5 | 54.7 | 55.0 |

Remarks
The amount of PEO added is 150 g/ton.
Phenol resin: Same as *2 in Example 3.
Composition of the paper stuff:

| | |
|---|---|
| TMP | 44% |
| Bleached pulp | 15% |
| DIP | 41% |

EXAMPLE 6

Experiment for the comparison of yield when a paper stuff containing 95% of deinked pulp (DIP) is used

TABLE 6

| Combination of chemicals and amount added (g/ton) | | Yield (%) | Yield of ash (%) |
|---|---|---|---|
| Blank (no addition) | | 53.6 | 17.8 |
| SPFR-1 | PEO | | |
| 100 | 50 | 71.7 | 53.0 |
| 200 | 100 | 87.5 | 80.2 |
| 300 | 150 | 93.9 | 93.2 |
| 400 | 200 | 95.6 | 94.0 |
| Inorganic filler *1 | A. PAAM *1 | | |
| 1000 | 100 | 66.8 | 46.5 |
| 1000 | 300 | 79.9 | 69.8 |
| 1000 | 500 | 81.9 | 69.2 |
| 1000 | 800 | 93.5 | 90.6 |
| C. PAAM *2 | A. PAAM *3 | | |
| 580 | 295 | 67.5 | 49.9 |
| Alum | A. PAAM *3 | | |
| 0 | 295 | 61.9 | 42.8 |
| 5000 | 295 | 65.9 | 49.2 |

TABLE 6-continued

| Combination of chemicals and amount added (g/ton) | | Yield (%) | Yield of ash (%) |
|---|---|---|---|
| 10000 | 295 | 67.0 | 50.3 |
| Alum | PEO | | |
| 5000 | 150 | 87.3 | 78.0 |
| 10000 | 150 | 86.9 | 81.0 |

Remarks

| | | |
|---|---|---|
| Composition of the paper stuff: | DIP | 95% |
| | BCMP | 5% |
| | (Bleached mechanical pulp) | |
| Concentration of the paper stuff: | 0.6% | |
| | Head box paper stuff | |
| Head box ash content: | 23.7% | |

*1: Same as *4 in Example 3.
*2: Cationic polyacrylamide
*3: Anionic polyacrylamide

EXAMPLE 7

Experiment for the comparison of freeness

TABLE 7

| Combination of chemicals and amount added (g/ton) | | Freeness time of 200 ml (sec.) |
|---|---|---|
| Blank (no addition) | | 143 |
| SPFR-1 | PEO | |
| 80 | 100 | 61 |
| 160 | 100 | 32 |
| 240 | 100 | 25 |
| 320 | 100 | 18 |
| Inorganic filler *1 | A. PAAM *1 | |
| 1000 | 100 | 124 |
| 1000 | 300 | 103 |
| 1000 | 500 | 85 |
| 1000 | 800 | 82 |

Remarks
Test method:
The freeness time of 200 ml was measured according to the device and the method described in Example.

| | | |
|---|---|---|
| Composition of the paper stuff: | Bleached pulp | 15.2% |
| | DIP | 8.5% |
| | GP | 18.0% |
| | TMP | 58.3% |
| Concentration of the paper stuff: | 0.8% | |

*1: Sample as *4 in Example 3.

Comparative Example 1

Experiment for the comparison of yield when the phenol resin of Example 3 was used as the phenol resin. Paper stuff-1 was used.

TABLE 8

| Amount of phenol resin added (g/ton) | Amount of PEO added and yield (%) | | | |
|---|---|---|---|---|
| | 0 | 50 | 100 | 200 |
| 0 | 48.3 | 49.8 | 50.6 | 54.3 |
| 200 | 49.6 | 55.8 | 57.1 | 59.7 |
| 400 | 49.5 | 59.5 | 84.1 | 68.8 |
| 600 | 50.9 | 56.8 | 67.4 | 72.0 |
| 1200 | 49.8 | 56.5 | 63.9 | 78.6 |

As apparent from the experimental results shown in Tables 1 to 8, it can be found that the sulfonated phenol-formaldehyde resin of the present invention is highly excellent as a yield improver. Further, the method of the present invention using this resin in combination with PEO is superior to other yield improving systems in not only the yield of fine fiber but also the yield of filler from the experimental result of Example 3. As shown in the experimental result of Example 4, the method of the present invention can provide an excellent yield of white water for paper-making, highly decreases contamination load in waste water treatment and saves waste water treating cost. Furthermore, in the experimental result of Example 5, the sulfonated phenol-formaldehyde resin of the present invention shows an excellent yield improving effect compared to the conventional phenol resin even for a paper stuff containing a large amount of DIP. The method of the present invention using such a resin together with PEO is also advantageous in a paper-making factory where the amount of DIP used is increasing.

The above-mentioned sulfonated phenol-formaldehyde resin of the present invention can improve the yields of fine fiber and filler in the paper-making process by a combined use of PEO. By using the method of the present invention using such a specific resin in combination with PEO, effects including an improvement in productivity, saving of paper-making materials and decrease in waste water treating load in the paper-making process or the waste water treating process.

What is claimed is:

1. A sulfonated phenol-formaldehyde resin for paper-making, which is a phenol resin used as a yield and freeness improver in combination with polyethylene oxide in the paper-making process and the waste water treating process, synthesized by sulfonating a phenol selected from the group consisting of bis(4-hydroxyphenyl)sulfone, 4,4'-dihydroxydiphenyl-2,2-propane, 1-naphthol, and 2-naphthol and then condensing the sulfonated phenol it with formaldehyde.

2. The sulfonated phenol-formaldehyde resin for paper-making according to claim 1, having a sulfonation degree of 0.4 to 0.8.

* * * * *

UNITED STATES PATENT AND TRADEMARK OFFICE

CERTIFICATE OF CORRECTION

PATENT NO. : 5,866,669
DATED : Hisao Takatsu, et. al.
INVENTOR(S) : February 2, 1999

It is certified that error appears in the above-identified patent and that said Letters Patent is hereby corrected as shown below:

Title page, item [73], Assignee: should read –Meisei – not "Meisel".

item [57], Abstract should read --

ABSTRACT

A sulfonated phenol-formaldehyde resin which, in combination with polyethylene oxide, acts as a yield improvement promotor for paper-making. The resin of the present invention is synthesized by sulfonation of phenols such as bis(4-hydroxyphenyl)sulfone, 4,4'-dihydroxydiphenyl-2,2-propane, 1-naphthol, or 2-naphthol, followed by condensation with formaldehyde. When used in combination with polyethylene oxide, the resin of the invention effects the paper-making process in the following manner: fine fiber and filler yield are increased, freeness of the paper product is increased, the life of the resulting paper is increased, discoloring of paper does not result even in the presence of high levels of de-inked pulp and filler, and waste water treating load is decreased.

Signed and Sealed this

Twenty-second Day of June, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,866,669
INVENTOR(S) : Hisao Takatsu, et. al.
DATED : February 2, 1999

It is certified that error appears in the above-identified patent and that said Letters Patent is hereby corrected as shown below:

Column 2, line 15, the word – wherein – should be inserted between "treating process" and said phenol resin".

Column 8, line 16, claim 1, the word "it" between "phenol" and "with" should be deleted.

Signed and Sealed this

Fourteenth Day of September, 1999

*Attest:*

Q. TODD DICKINSON

*Attesting Officer*

*Acting Commissioner of Patents and Trademarks*